US007168611B2

(12) United States Patent
Thompson et al.

(10) Patent No.: US 7,168,611 B2
(45) Date of Patent: Jan. 30, 2007

(54) POSTAL RECEPTACLE ASSEMBLY AND METHOD OF MAKING SAME

(76) Inventors: David C. Thompson, 293 Lorraine Rd., Glen Ellyn, IL (US) 60137; Rayanne S. Thompson, 293 Lorraine Rd., Glen Ellyn, IL (US) 60137

( * ) Notice: Subject to any disclaimer, the term of this patent is extended or adjusted under 35 U.S.C. 154(b) by 74 days.

(21) Appl. No.: 10/704,124

(22) Filed: Nov. 10, 2003

(65) Prior Publication Data

US 2005/0098618 A1 May 12, 2005

(51) Int. Cl.
*A47G 29/12* (2006.01)

(52) U.S. Cl. ..... 232/38; 232/17; 232/45; 232/19; 232/39

(58) Field of Classification Search ..... 232/38, 232/39, 17, 45, 19; D99/29–32
See application file for complete search history.

(56) References Cited

U.S. PATENT DOCUMENTS

D166,749 S * 5/1952 Heinz ..... D99/30
D199,043 S * 9/1964 Duncan et al. ..... D99/29
D256,287 S * 8/1980 McConnell ..... D99/30
4,359,185 A * 11/1982 Castro ..... 232/17
D291,937 S * 9/1987 Fisher ..... D99/30
D296,602 S * 7/1988 Klein ..... D99/30
D308,124 S * 5/1990 Janzer ..... D99/30
D312,912 S * 12/1990 Klahre ..... D99/29
D322,418 S * 12/1991 White ..... D11/144
D331,481 S * 12/1992 Barlow ..... D99/30
D422,773 S * 4/2000 Klein ..... D99/30
D493,269 S * 7/2004 Burgos et al. ..... D99/30

* cited by examiner

*Primary Examiner*—William L. Miller
(74) *Attorney, Agent, or Firm*—Nixon & Vanderhye, P.C.

(57) ABSTRACT

A postal receptacle assembly (20A, 20B, 20C, 20D) comprises a postal receptacle component (22) which is spatially framed by other components of the postal receptacle assembly. The other components include a horizontally-oriented stoop (24); two columns (26) mounted on the stoop and extending essentially vertically parallel in spaced apart relationship; and, a pediment (28) supported by the two columns. The postal receptacle component (22) is situated in a space (30) framed in two dimensions by the stoop (24), the pediment (28), and the two columns (26). In certain embodiments the postal receptacle assembly is configured to visually emulate the appearance of a building or portion of a building (e.g., a porch). One or more of the assembly components (known as "stylistic" components) may be formed with (or structurally and/or visually convey) selected architectural features. Preferably the architectural features of the stylistic components are architecturally compatible with or architecturally complementary to the building or structure having avertical member (e.g., post, wall, or surface) upon which the postal receptacle assembly is to be attached or hung. Examples of stylistic components of the postal receptacle assembly include one or more of the column components and the pediment component.

20 Claims, 23 Drawing Sheets

POSTAL RECEPTACLE ASSEMBLY AND METHOD OF MAKING SAME

BACKGROUND

1. Field of the Invention

The present invention pertains to postage receptacles such as letter boxes and mail boxes.

2. Related Art and Other Considerations

There is a type of mail box which is mounted or hung on a vertical wall or post of a building, usually proximate a door of the building. Such mailboxes typically have simple structure and ordinary appearance, and as such detract from (or at best add little to) the overall appearance or aesthetics of the building.

BRIEF SUMMARY

A postal receptacle assembly comprises a postal receptacle component which is spatially framed by other components of the postal receptacle assembly. The other components include a horizontally-oriented stoop; two columns mounted on the stoop and extending essentially vertically in spaced apart, parallel relationship; and, a pediment supported by the two columns. The postal receptacle component is situated in a space framed in two dimensions by the stoop, the pediment, and the two columns.

The postal receptacle component comprises an essentially hollow postage receptacle container. The postage receptacle container has a backwall; two vertically extending sidewalls; and, a frontwall. In one embodiment, at least a portion of the front wall of the postage receptacle container is formed by or includes a door which pivots for permitting access to the interior of the postage receptacle container. The postal receptacle component is preferably mounted on the stoop component. The postal receptacle component is configured for mounting on a vertically oriented surface and comprises means for mounting the postal receptacle assembly on a vertical wall or post of a building (such as a house, dwelling, or residence, for example).

A top wall of the postage receptacle container can take the form of a lid which pivots for permitting access to an interior of the postage receptacle container. Alternatively, the top wall of the postage receptacle container can have a slit or other aperture through which postage items, e.g., letters or post cards, can be inserted.

As one of its aspects, certain embodiments of the postal receptacle assembly are configured to visually emulate the appearance of a building or portion of a building, such as a porch. For example, the assembly components may be connected in a manner whereby the postal receptacle assembly simulates a front door and porch of a building.

As a further aspect, in certain embodiments of the postal receptacle assembly, one or more of the assembly components (known as "stylistic" components) may be formed with (or structurally and/or visually convey) selected architectural features. Preferably the architectural features of the stylistic components are architecturally compatible with or complementary to the host building or structure having the vertical wall, post, or surface upon which the postal receptacle assembly is to be attached or hung. When two or more of the assembly components are stylistic components, preferably the architectural features of the two or more stylistic components comprise a common architectural style or genre.

Examples of stylistic components of the postal receptacle assembly include the column components and the pediment component. The column component may express an architectural feature by being one of the following: a column having a shaft with square cross section; a column having a shaft with a round cross section; and, a column having a shaft with plural discrete shaft sections of differing cross sectional dimensions (e.g., a "Victorian" column). The pediment component may express an architectural feature by being one of the following: an essentially rectangular (e.g., "Greek") pediment; an open-topped pediment (also known as broken-apex pediment); and, an open-bed pediment (also known as broken-bed pediment). At least one, and preferably all, of the assembly components of a postal receptacle assembly are of a color selected for architectural compatibility with the building or structure to which the wall-mounted postal receptacle assembly is to be mounted.

The present invention also encompasses method for fabricating a postal receptacle assembly using the plural assembly components. At least some of the plural assembly components are of differing types, e.g., a postal receptacle component, a column component, a stoop component, and a pediment component. The method includes a step of selecting (as a stylistic component) at least one of the plural assembly components (e.g., the column component and the pediment component) from a collection of assembly components of a same type, differing members of the collection having differing architectural features. In a column selection mode of the method, the stylistic component is one of the two column components, and the members of the collection of column components include a column having a shaft with a square cross section; a column having a shaft with a round cross section; and, column having a shaft with plural discrete shaft sections of differing cross sectional dimensions (e.g., "a Victorian" column). In a pediment selection mode of the method, the members of the collection of pediment components include: an essentially rectangular (e.g., "Greek" pediment); an open-topped or broken-apex pediment; and, an open-bed or broken-bed pediment.

In one implementation, the method further comprises the step of selecting the stylistic component from the appropriate collection in accordance with architectural compatibility with a building, post, or surface to which the postal receptacle assembly is attached, mounted, or hung.

Another step of the method involves connecting the plural assembly components (including the stylistic component) whereby the postal receptacle component occupies a space which is at least partially framed by another of the plural assembly components. In one implementation, the step of connecting the plural assembly components comprises: mounting the postal receptacle component on the stoop component; mounting the two column components on the stoop whereby the two column components extend essentially vertically in spaced apart relationship; and, mounting the pediment component to tops of the two columns and above the postal receptacle component.

In one implementation, the method involves connecting the plural assembly components whereby the connected components visually emulate an appearance of a building or portion of a building, such as a porch.

The method optionally includes a further step of selecting a color for each of the assembly components.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other embodiments that depart from these specific details. In other instances, detailed descriptions of well-known devices and methods are omitted so as not to obscure the description of the present invention with unnecessary detail. Moreover, individual function blocks are shown in some of the figures.

Figure 1A:
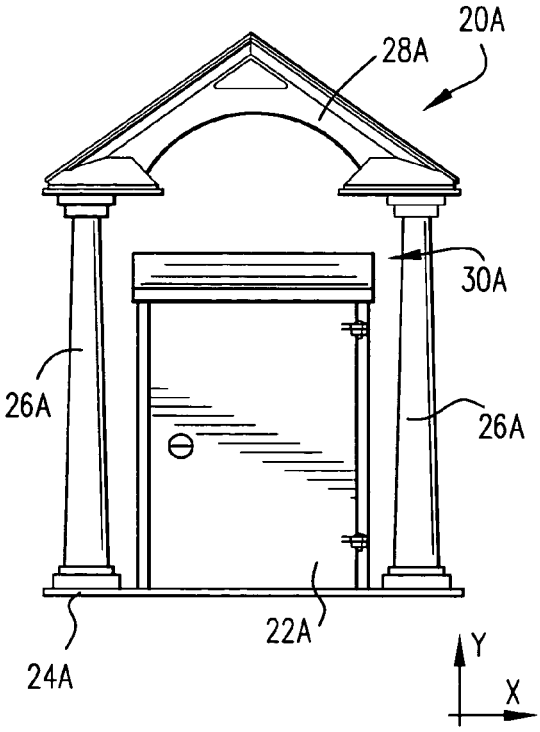
FIG. 1A, FIG. 1B, FIG. 1C, and FIG. 1D are front views of differing embodiments of postal receptacle assemblies.

FIG. 1A shows an example postal receptacle assembly 20A which comprises a postal receptacle component 22A. The postal receptacle component 22A is spatially framed in two dimensions (e.g., along the X and Y axes of FIG. 1A) by other components of the postal receptacle assembly 20A. The other components include a horizontally-oriented base or stoop component 24A; two column components 26A; and, a pediment component 28A.

The two column components 26A are mounted on the stoop component 24A and extend essentially vertically. That is, the two column components 26A extend parallel to one another along the Y axis in FIG. 1A. The two column components 26A are situated in spaced apart relationship with respect to their placement on stoop component 24A along the X axis, with the postal receptacle component 22A being situated on stoop component 24A intermediate the two column components 26A in the direction of the X axis.

The pediment component 28A is supported by and bridges the two column components 26A. Thus, in the sense of the Y axis of FIG. 1A, the pediment component 28A is situated above the other components.

In view of the foregoing, it will be understood that the postal receptacle component 22A is situated in a space 30A which is framed in two dimensions (along the X axis and the Y axis) by stoop component 24A, pediment component 28A, and the two column components 26A.

As used herein, the terms "column" and "column component" are not limited to architectural columns per se, but can be any vertical member which spans the stoop component 24 and the pediment component 28 in the Y direction. Moreover, It should be understood that the postal receptacle assembly 20A could include more than two columns. For example, in one variation four columns components 26 could be provided, with the four column components being mounted at or proximate corners of a rectangular stoop component to extend vertically along the Y axis. In this variation, therefore, there are two column components on each side of the postage receptacle component 22A.

The postal receptacle assembly 20A is preferably attached or hung on a vertical member (e.g., wall, post, or surface) of a building or structure, such as a residential unit or dwelling (for example). As such, in one implementation, the texture of the building wall/surface (e.g., siding, wood, brick, etc.) can be seen in the space 30A which is framed by perimeter components postal receptacle assembly 20A.

Figure 1B:
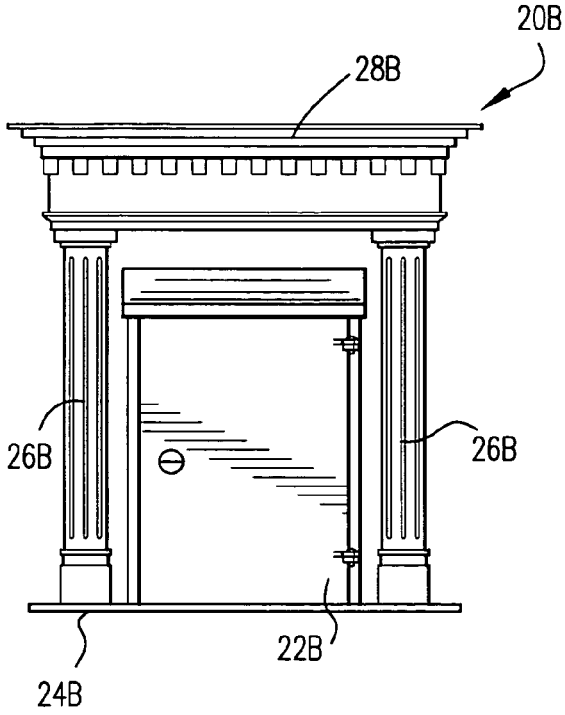
Figure 1C:
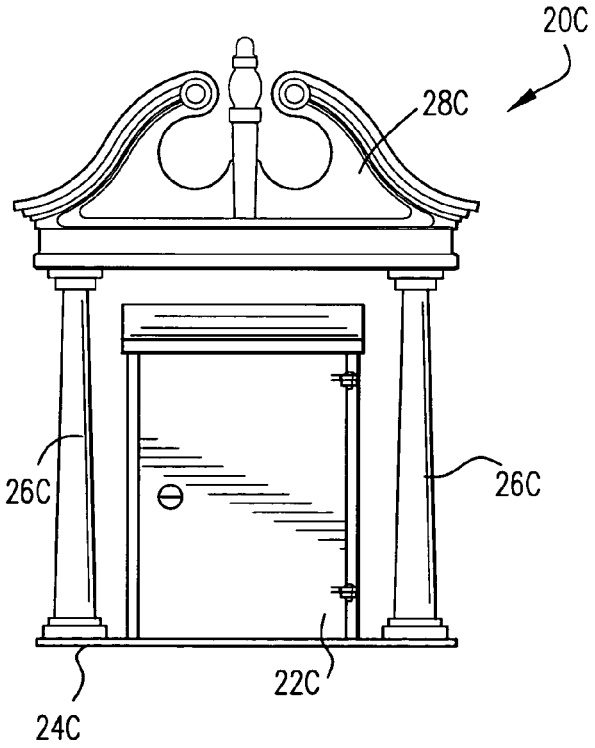
Figure 1D:
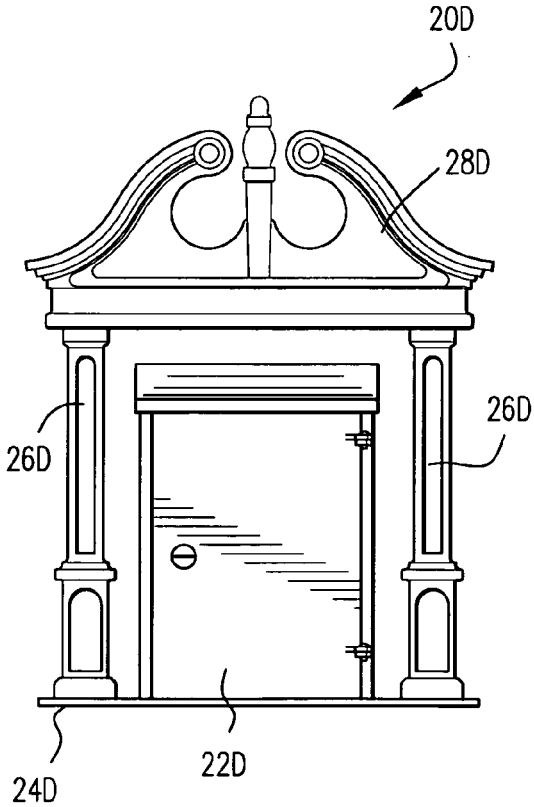

FIG. 1B, FIG. 1C, and FIG. 1D illustrate other embodiments of example postal receptacle assemblies 20B, 20C, and 20D, respectively, which have comparable assembly components to the postal receptacle assembly 20A of FIG. 1A. As explained subsequently, these other embodiments primarily differ from the postal receptacle assembly 20A in that certain assembly components having differing architectural features. But in terms of general structure, the postal receptacle assembly 20B, postal receptacle assembly 20C, and postal receptacle assembly 20D each have a stoop component 24; two column components 26; a pediment component 28; with these components framing a postal receptacle component 22. The components of the postal receptacle assembly 20B, the postal receptacle assembly 20C, and the postal receptacle assembly 20D bear comparably numbered reference numerals with alphabetically corresponding suffixes. Hereinafter, usage of a reference numeral in conjunction with an assembly component (such as postal receptacle component 22, stoop component 24, column components 26, or pediment component 28) without a specific alphabetical suffix is intended to refer generically to such component without regard to a specific architectural stylistic embodiment.

Figure 4A:
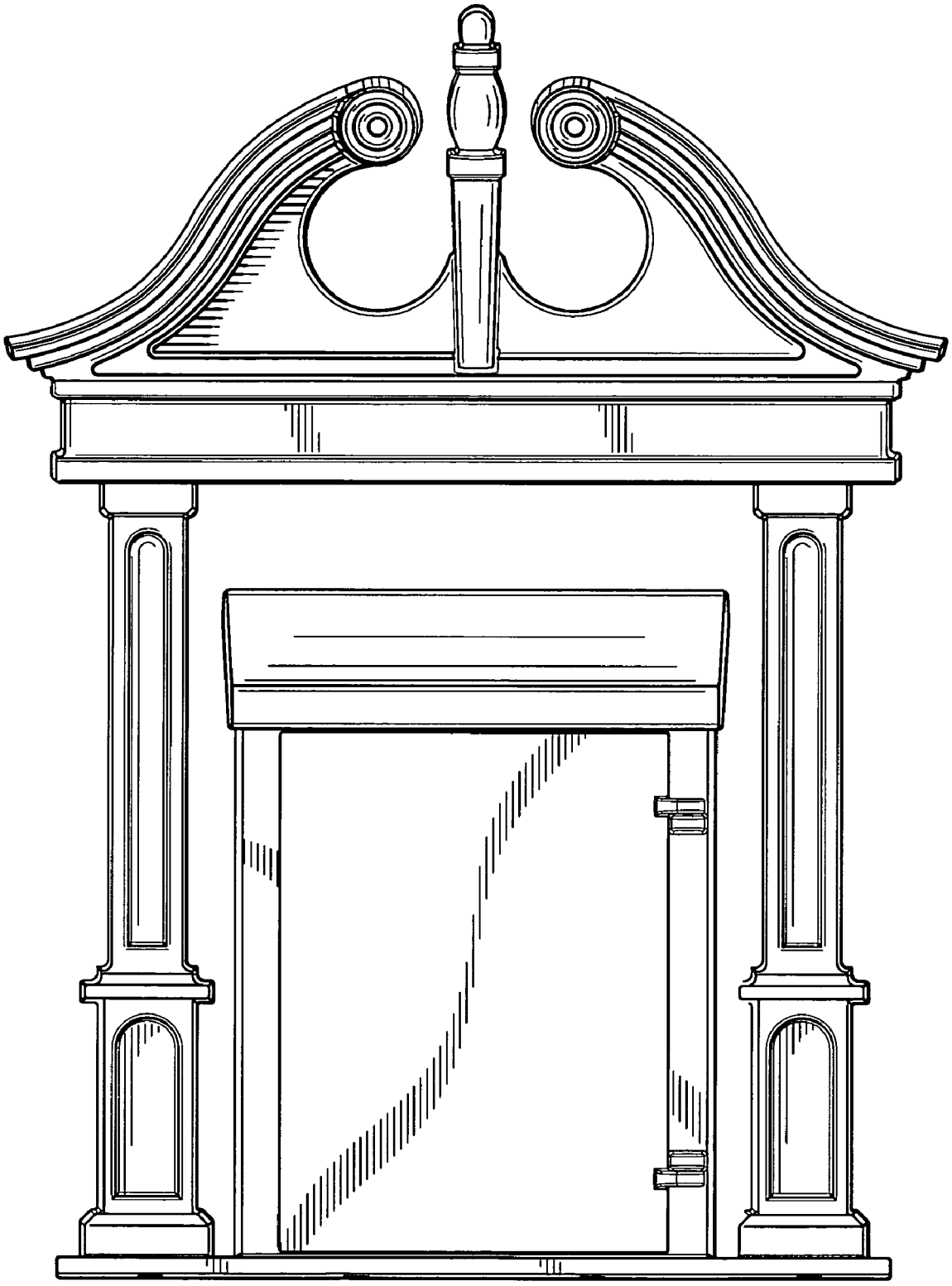
FIG. 4A is a front view of an embodiment of a postal receptacle assembly.
Figure 4B:
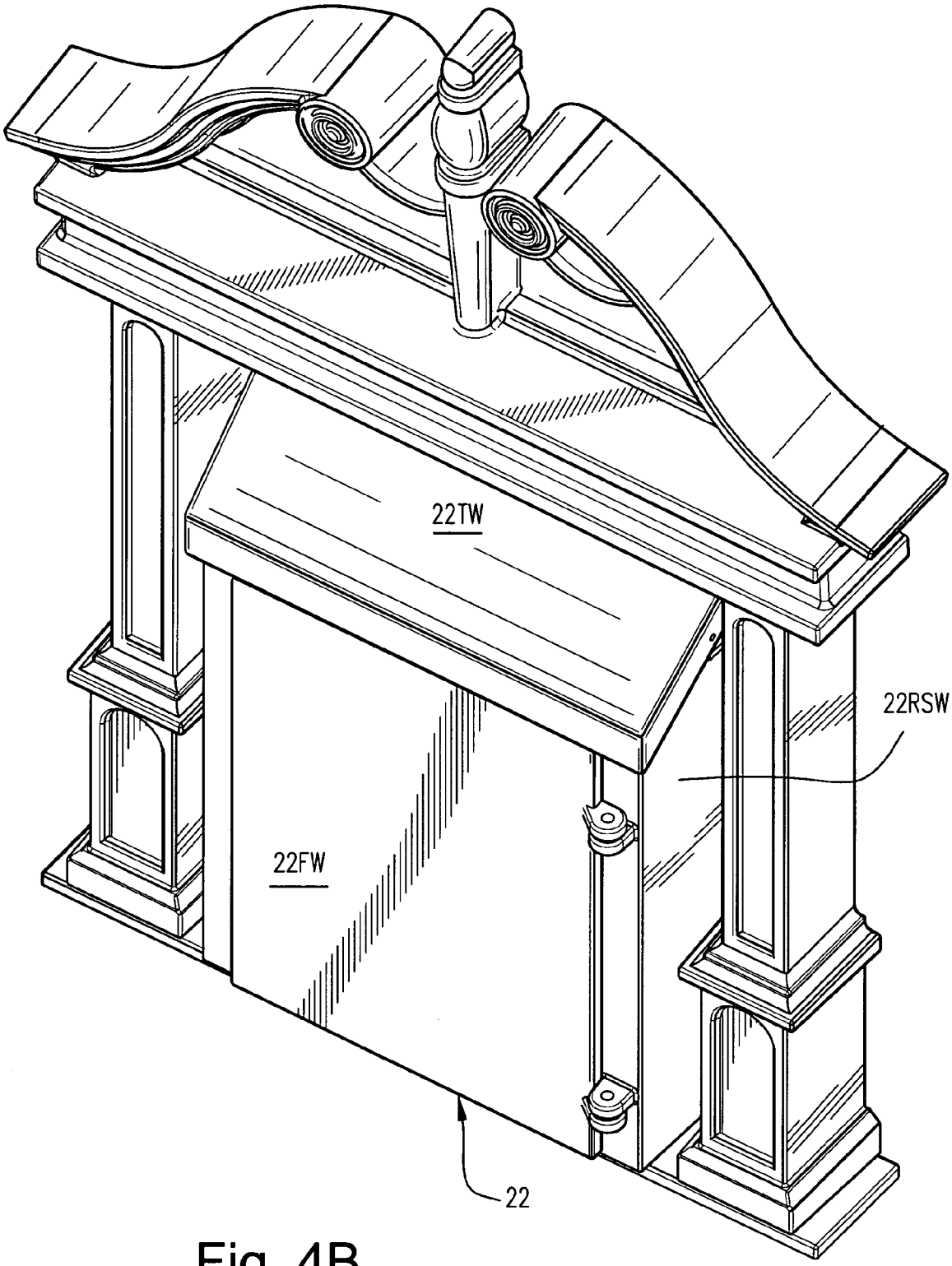
FIG. 4B is a top perspective view of the postal receptacle assembly of FIG. 4A.
Figure 4C:
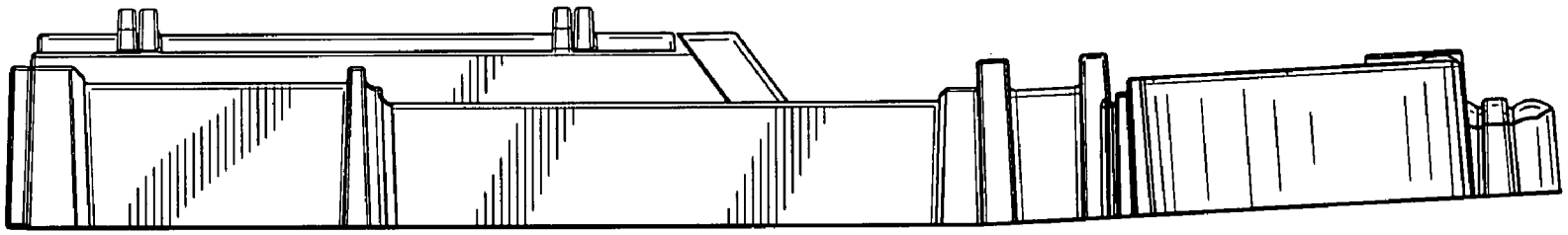
FIG. 4C is left side view of the postal receptacle assembly of FIG. 4A.
Figure 4D:
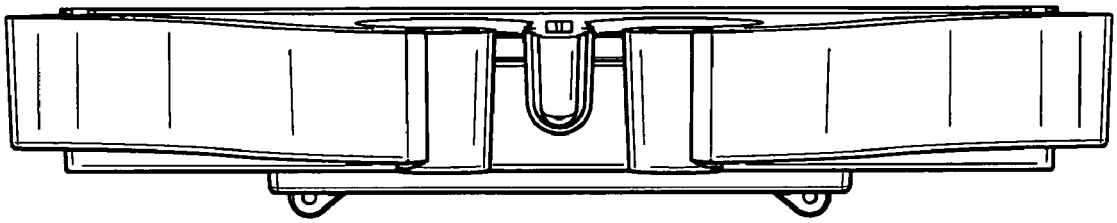
FIG. 4D is top view of the postal receptacle assembly of FIG. 4A.
Figure 4E:
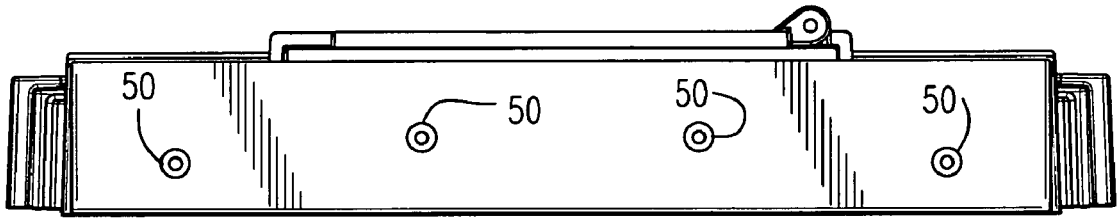
FIG. 4E is bottom view of the postal receptacle assembly of FIG. 4A.
Figure 4F:
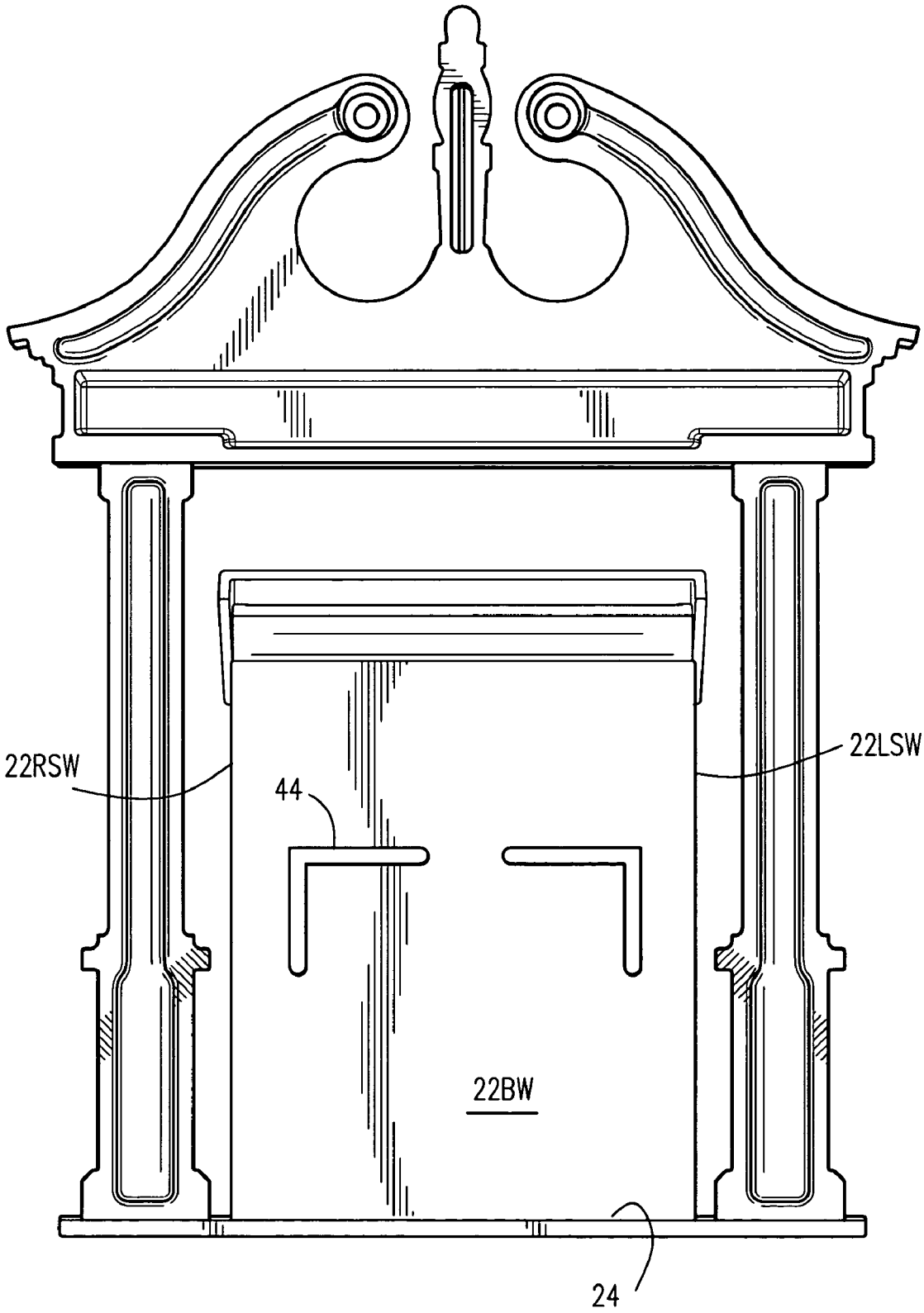
FIG. 4F is back view of the postal receptacle assembly of FIG. 4A.
Figure 5A:
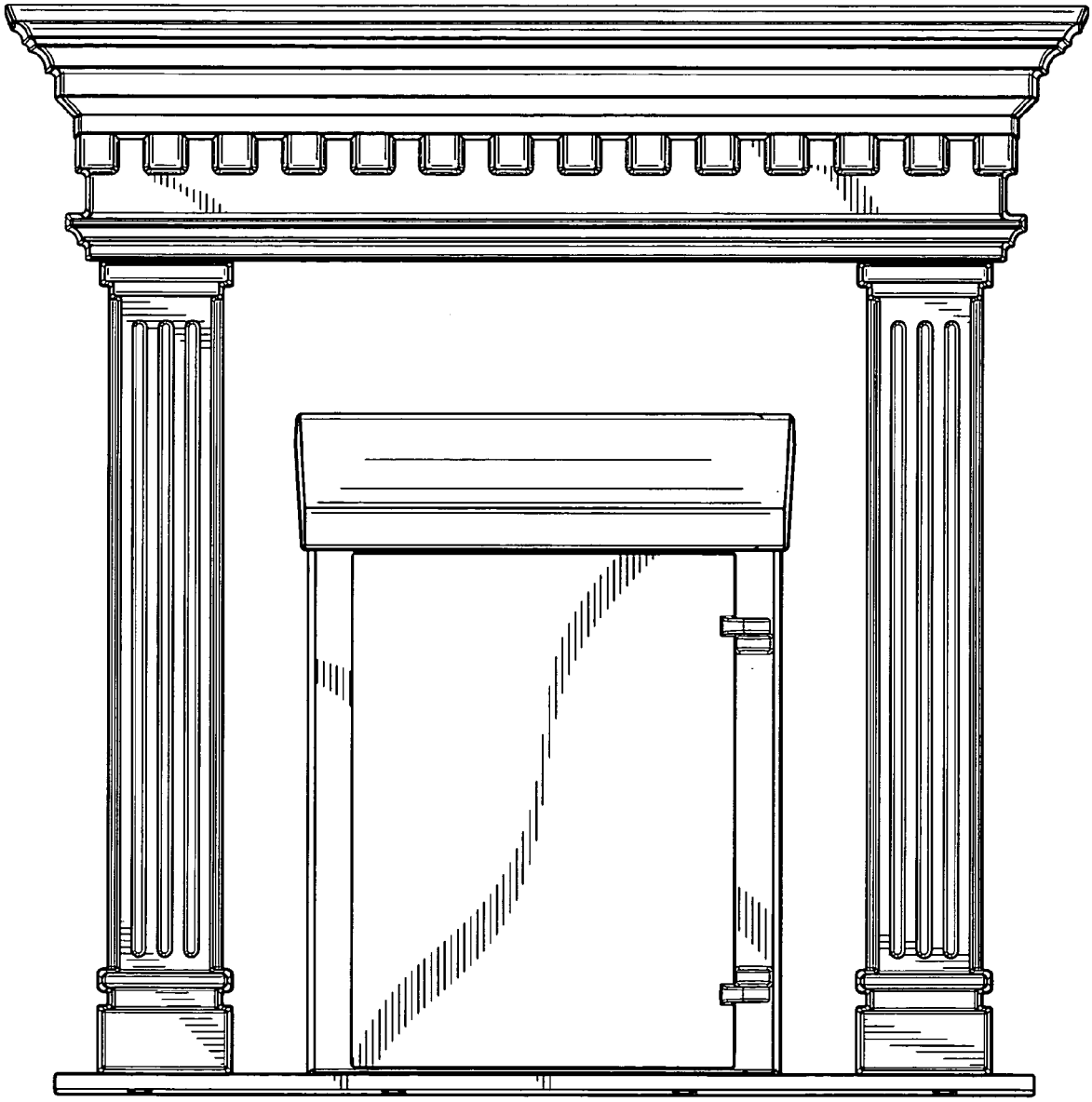
FIG. 5A is a front view of another embodiment of a postal receptacle assembly.
Figure 5B:
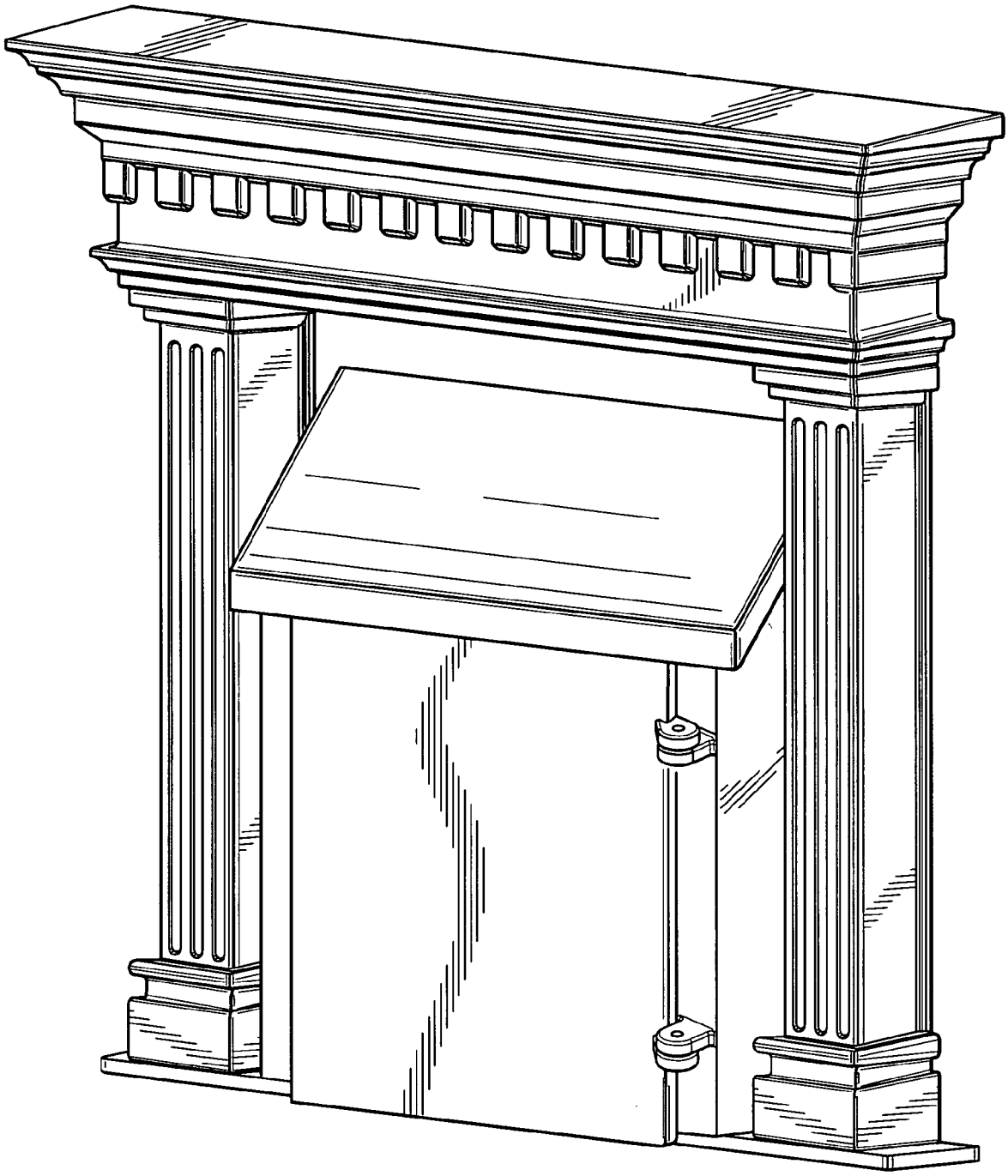
FIG. 5B is a top perspective view of the postal receptacle assembly of FIG. 5A.
Figure 5C:
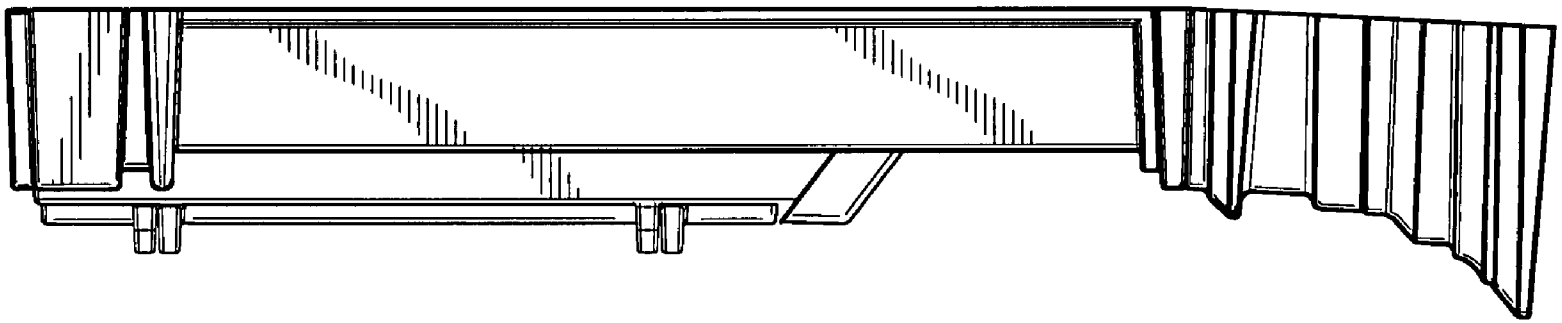
FIG. 5C is left side view of the postal receptacle assembly of FIG. 5A.
Figure 5D:
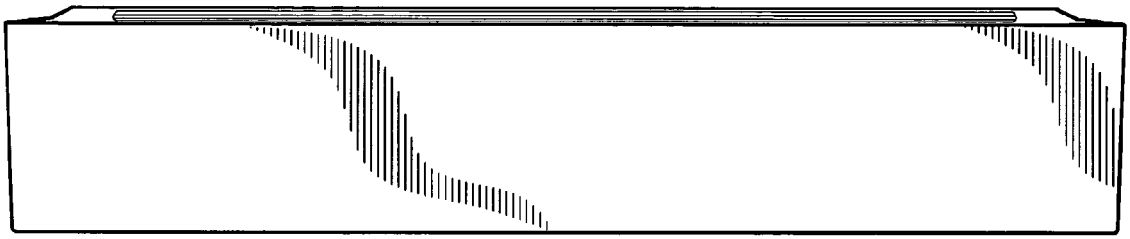
FIG. 5D is top view of the postal receptacle assembly of FIG. 5A.
Figure 5E:
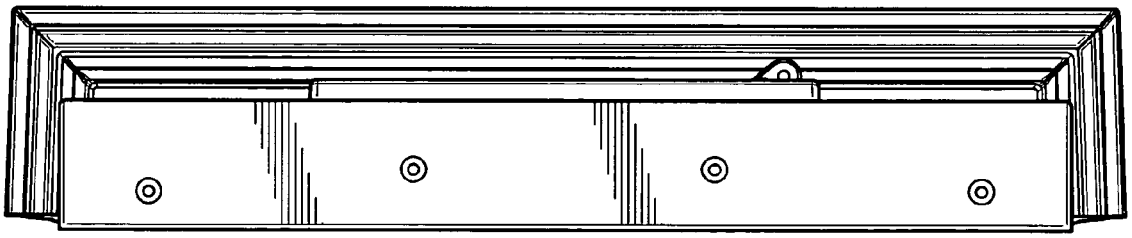
FIG. 5E is bottom view of the postal receptacle assembly of FIG. 5A.
Figure 5F:
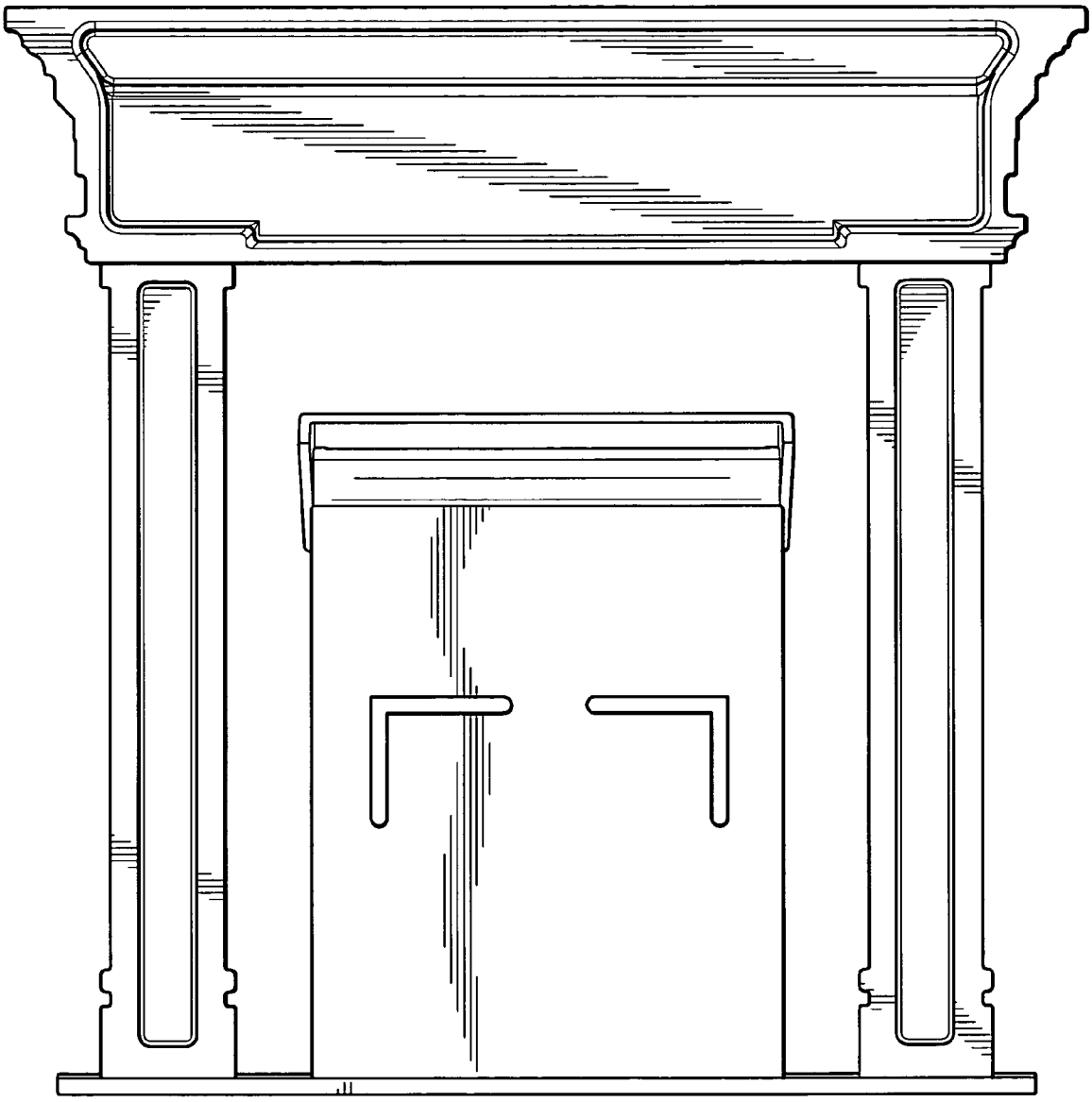
FIG. 5F is back view of the postal receptacle assembly of FIG. 5A.
Figure 6A:
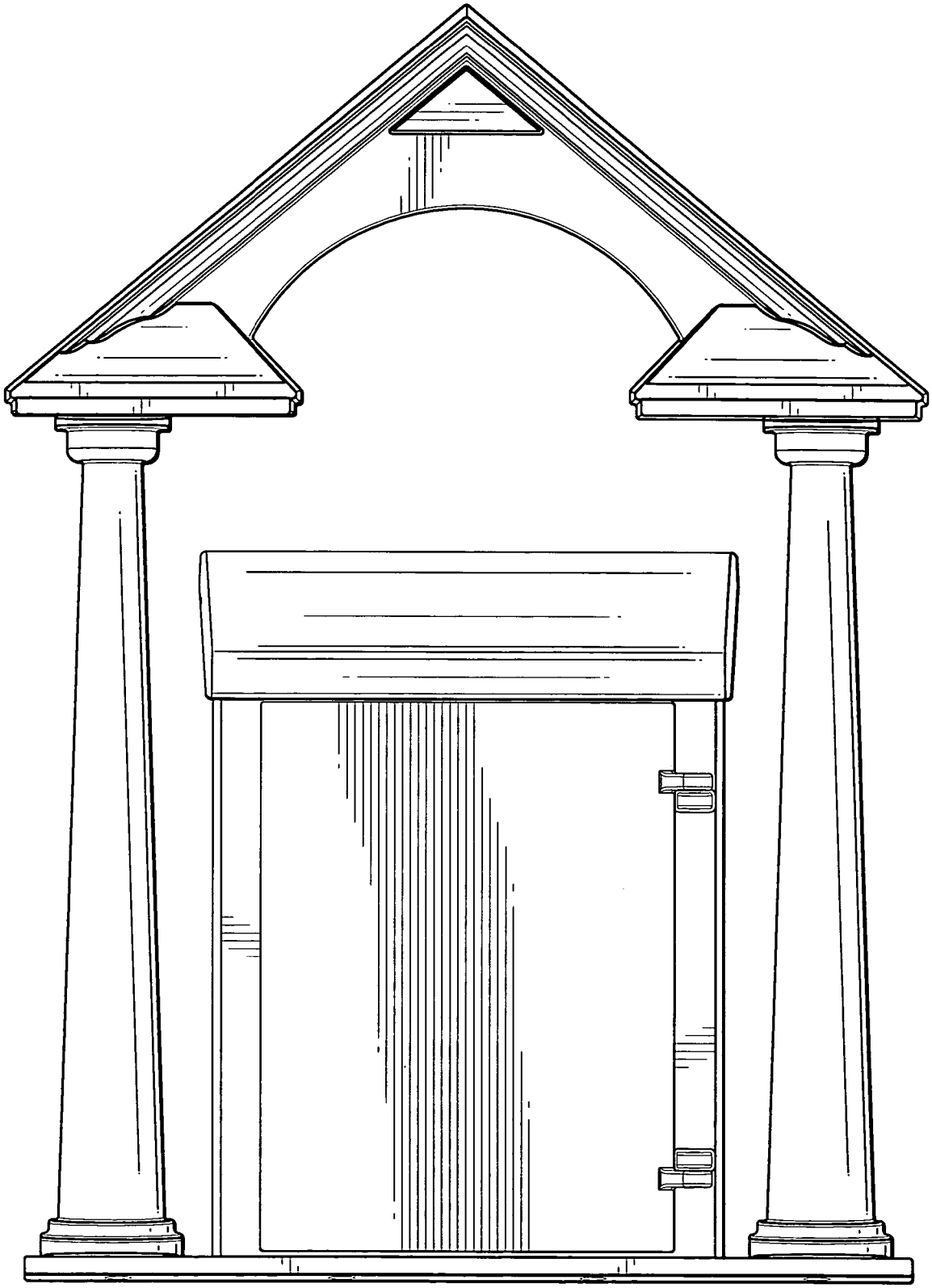
FIG. 6A is a front view of yet another embodiment of a postal receptacle assembly.
Figure 6B:
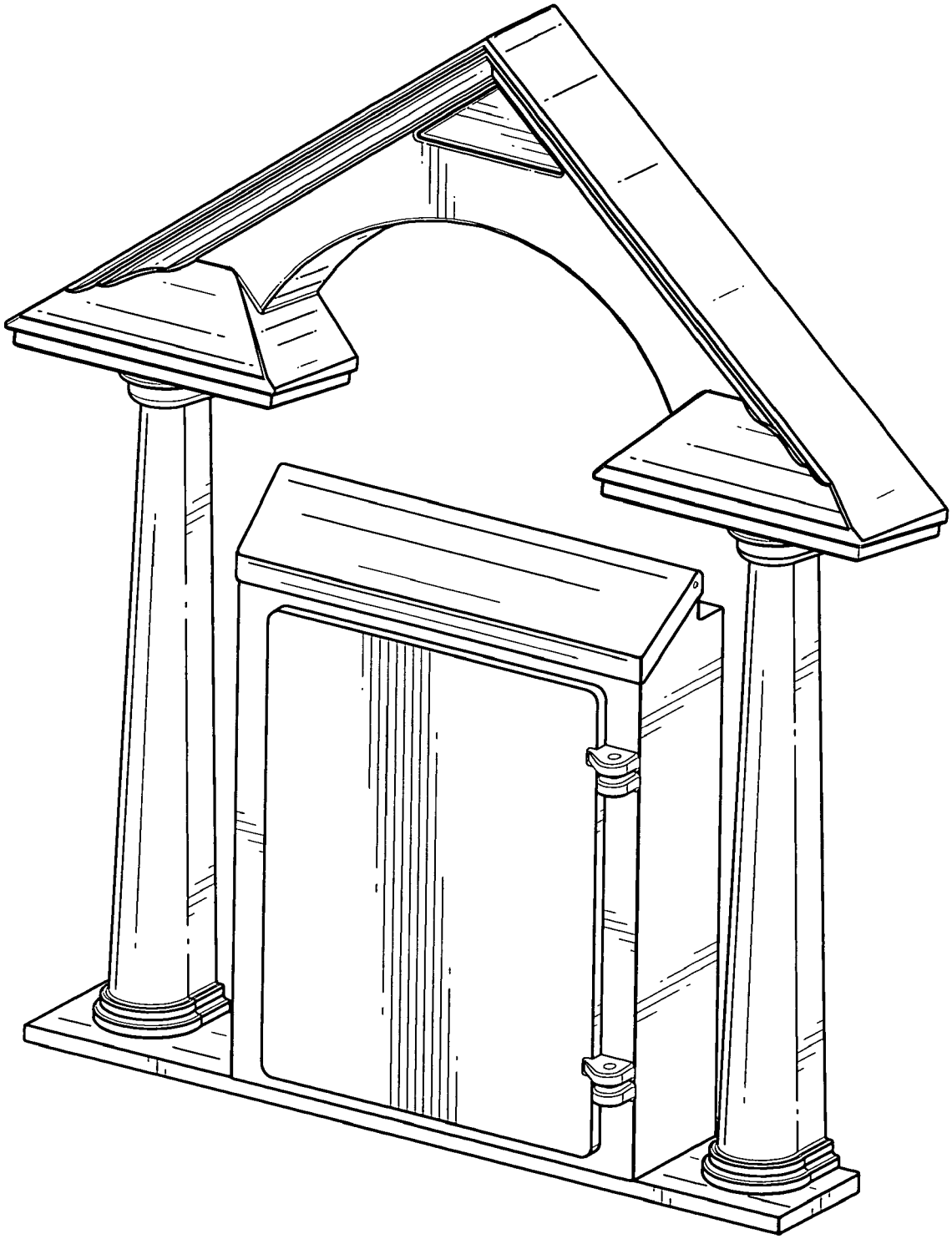
FIG. 6B is a top perspective view of the postal receptacle assembly of FIG. 6A.
Figure 6C:
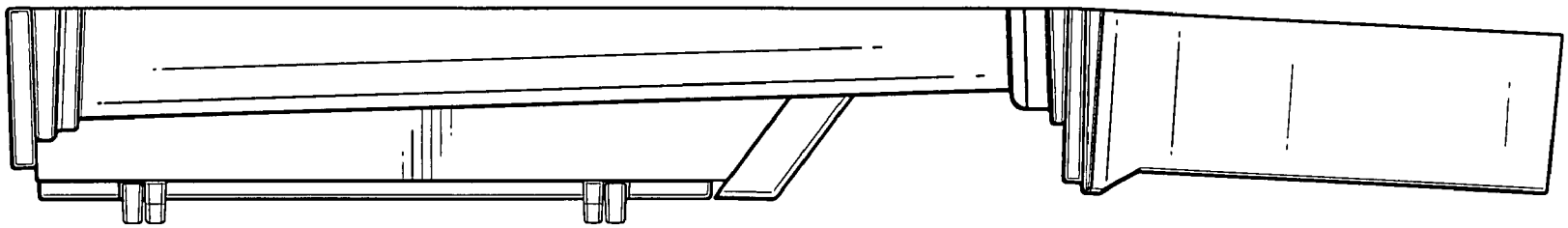
FIG. 6C is left side view of the postal receptacle assembly of FIG. 6A.
Figure 6D:
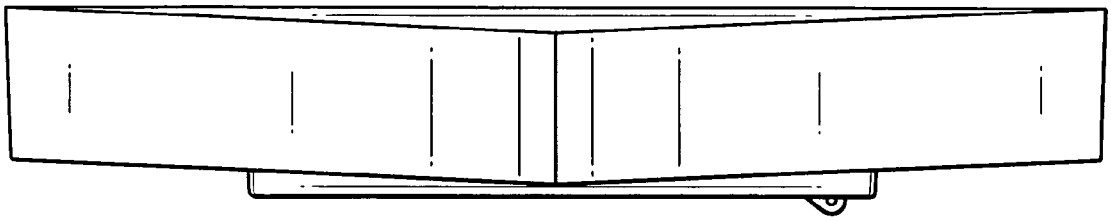
FIG. 6D is top view of the postal receptacle assembly of FIG. 6A.
Figure 6E:
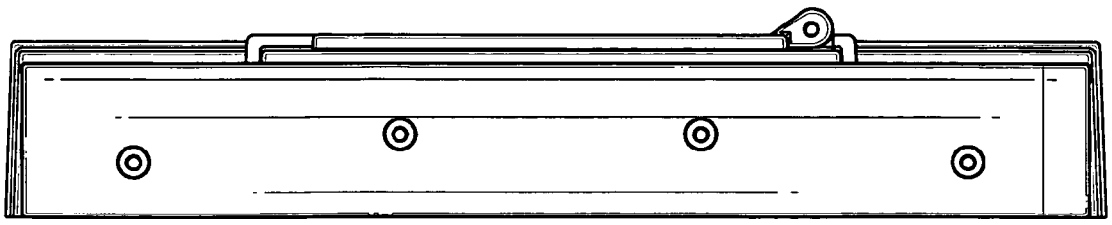
FIG. 6E is bottom view of the postal receptacle assembly of FIG. 6A.
Figure 6F:
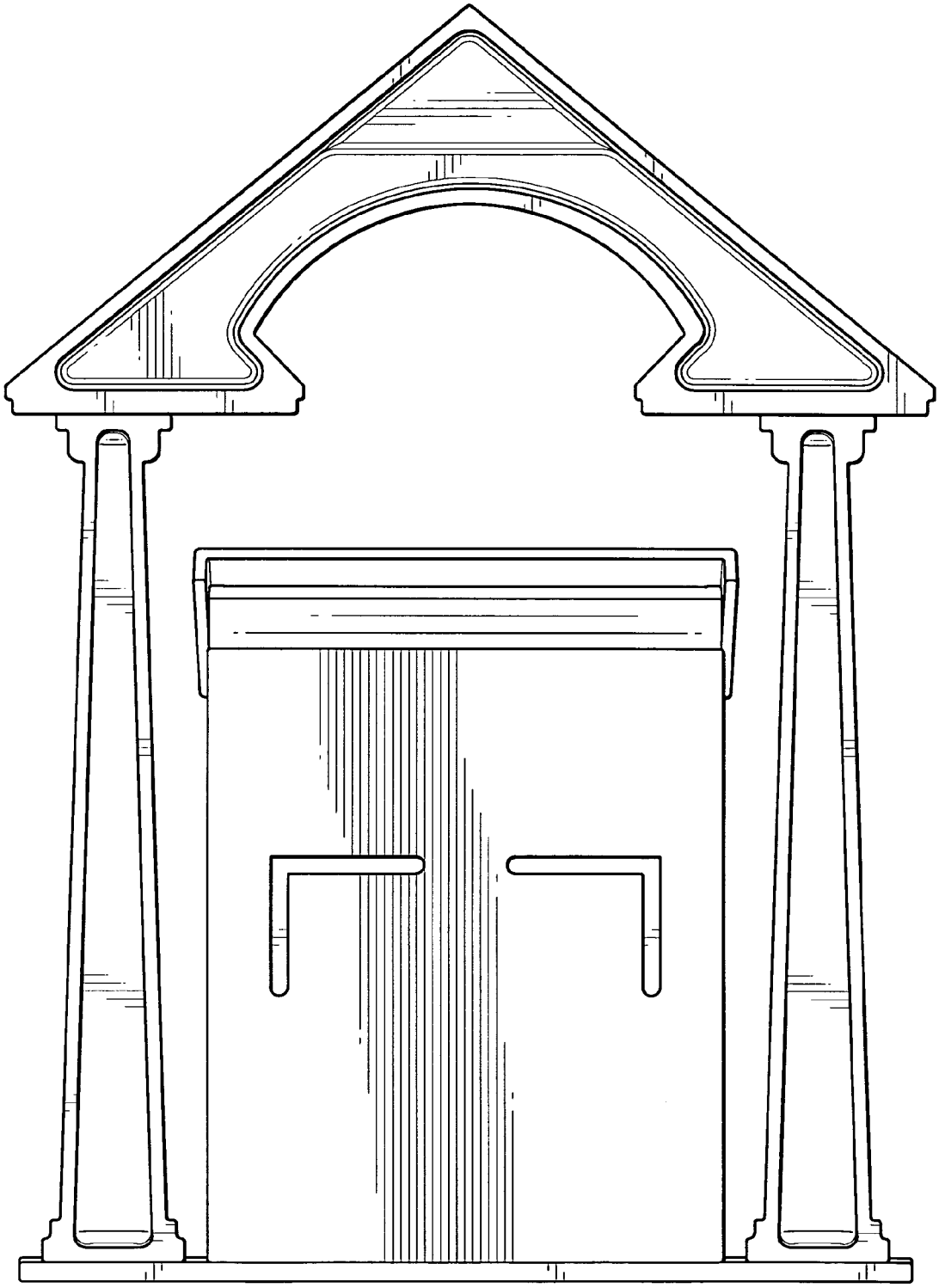
FIG. 6F is back view of the postal receptacle assembly of FIG. 6A.
Figure 7A:
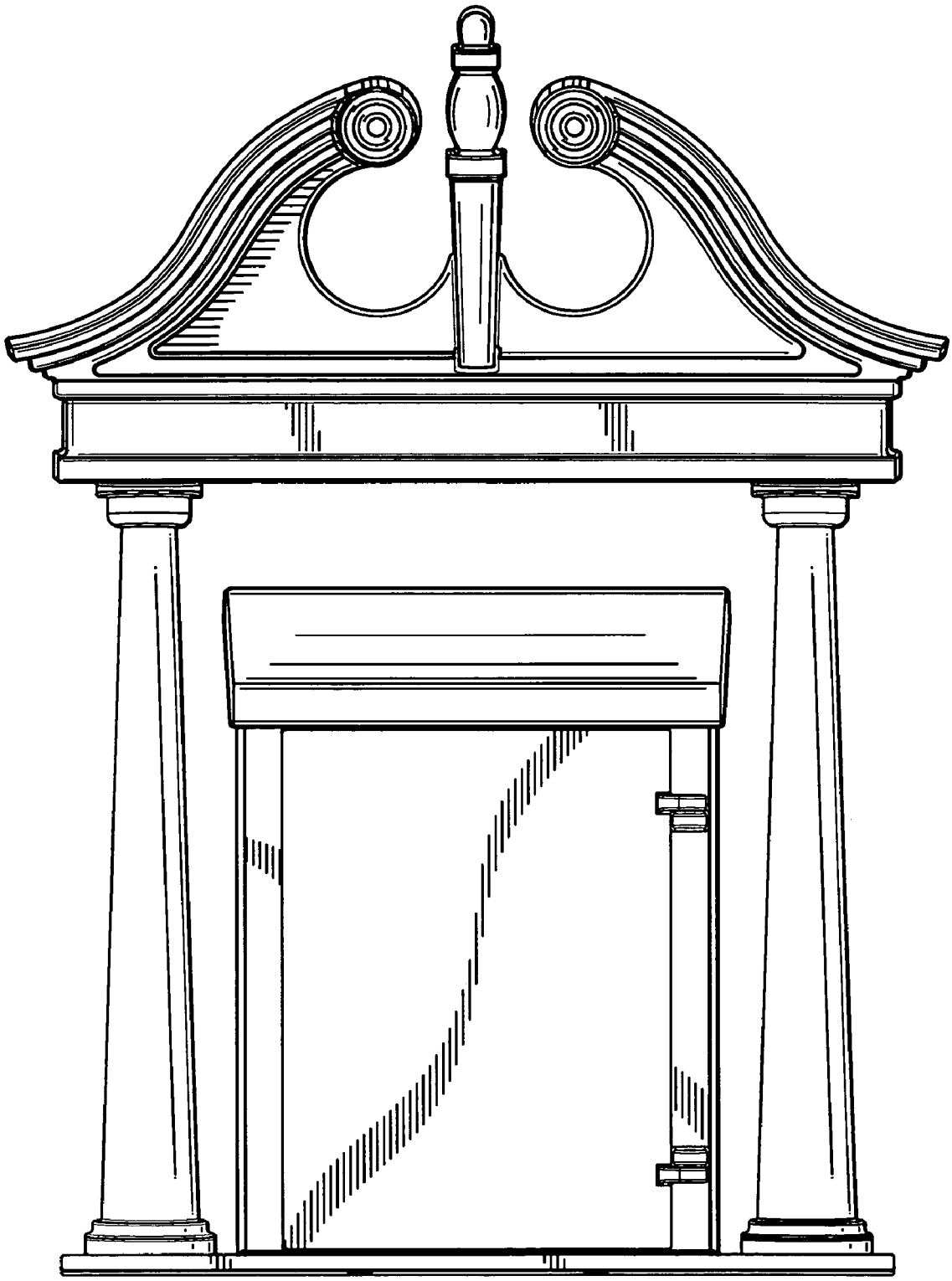
FIG. 7A is a front view of still another embodiment of a postal receptacle assembly.
Figure 7B:
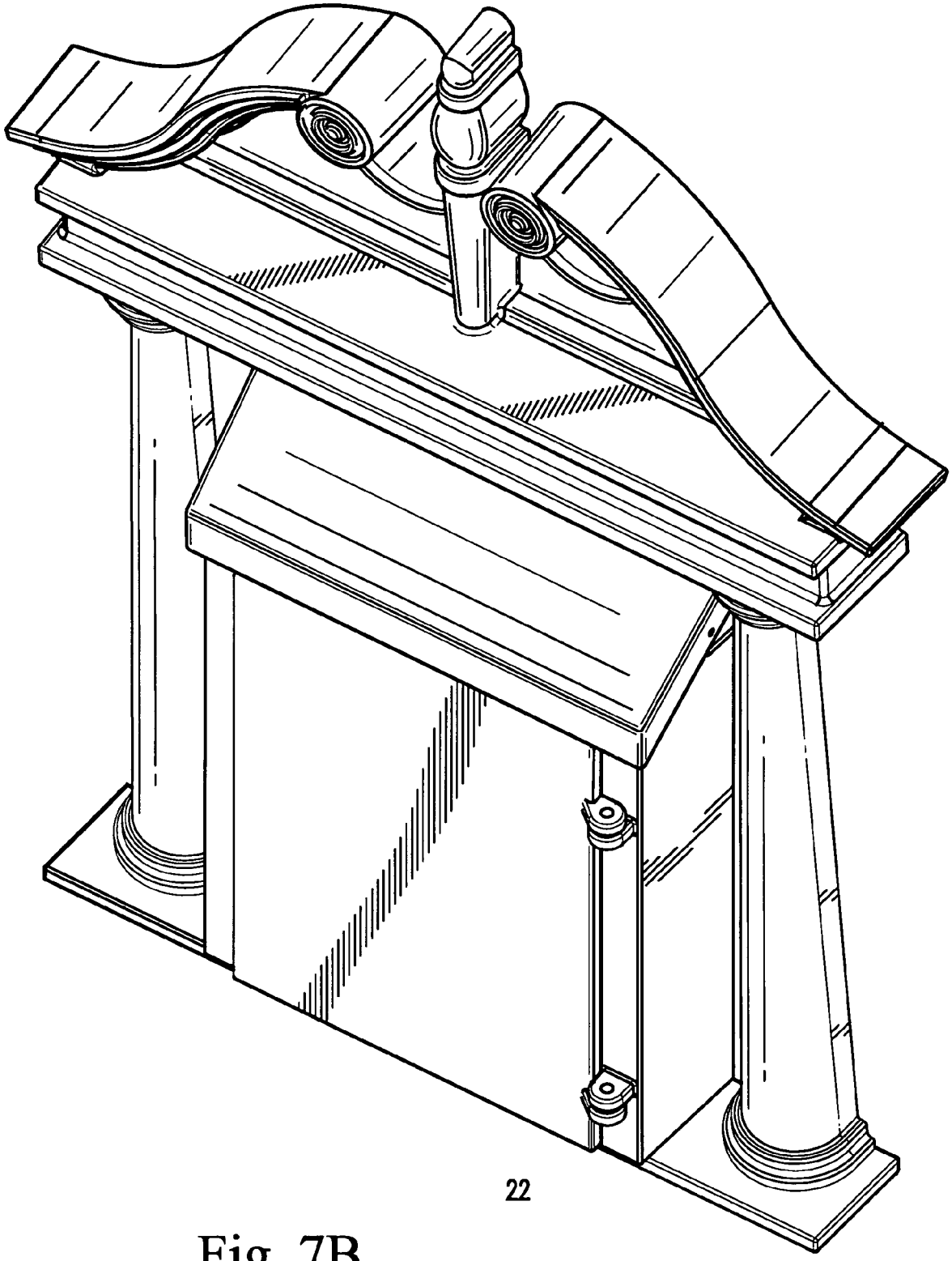
FIG. 7B is a top perspective view of the postal receptacle assembly of FIG. 7A.
Figure 7C:
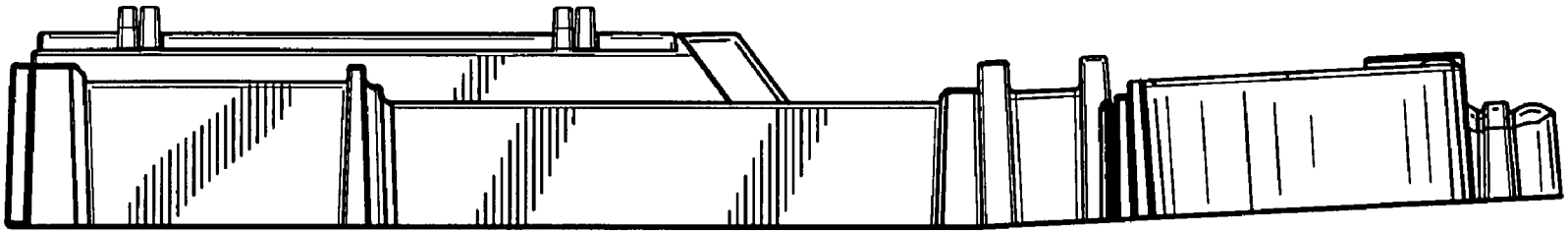
FIG. 7C is left side view of the postal receptacle assembly of FIG. 7A.
Figure 7D:
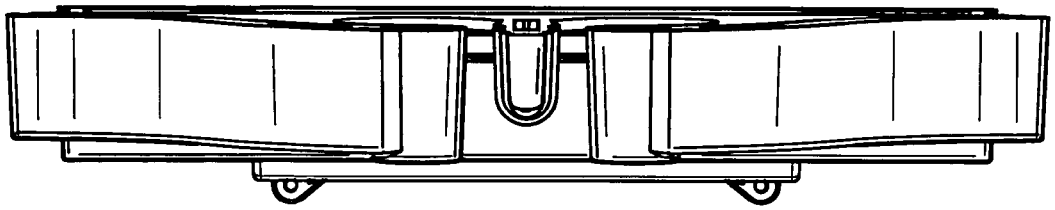
FIG. 7D is top view of the postal receptacle assembly of FIG. 7A.
Figure 7E:
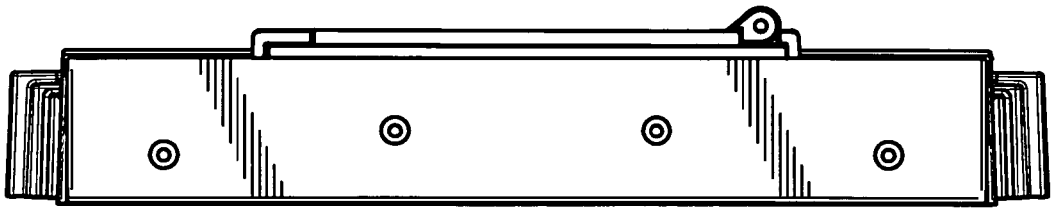
FIG. 7E is bottom view of the postal receptacle assembly of FIG. 7A.
Figure 7F:
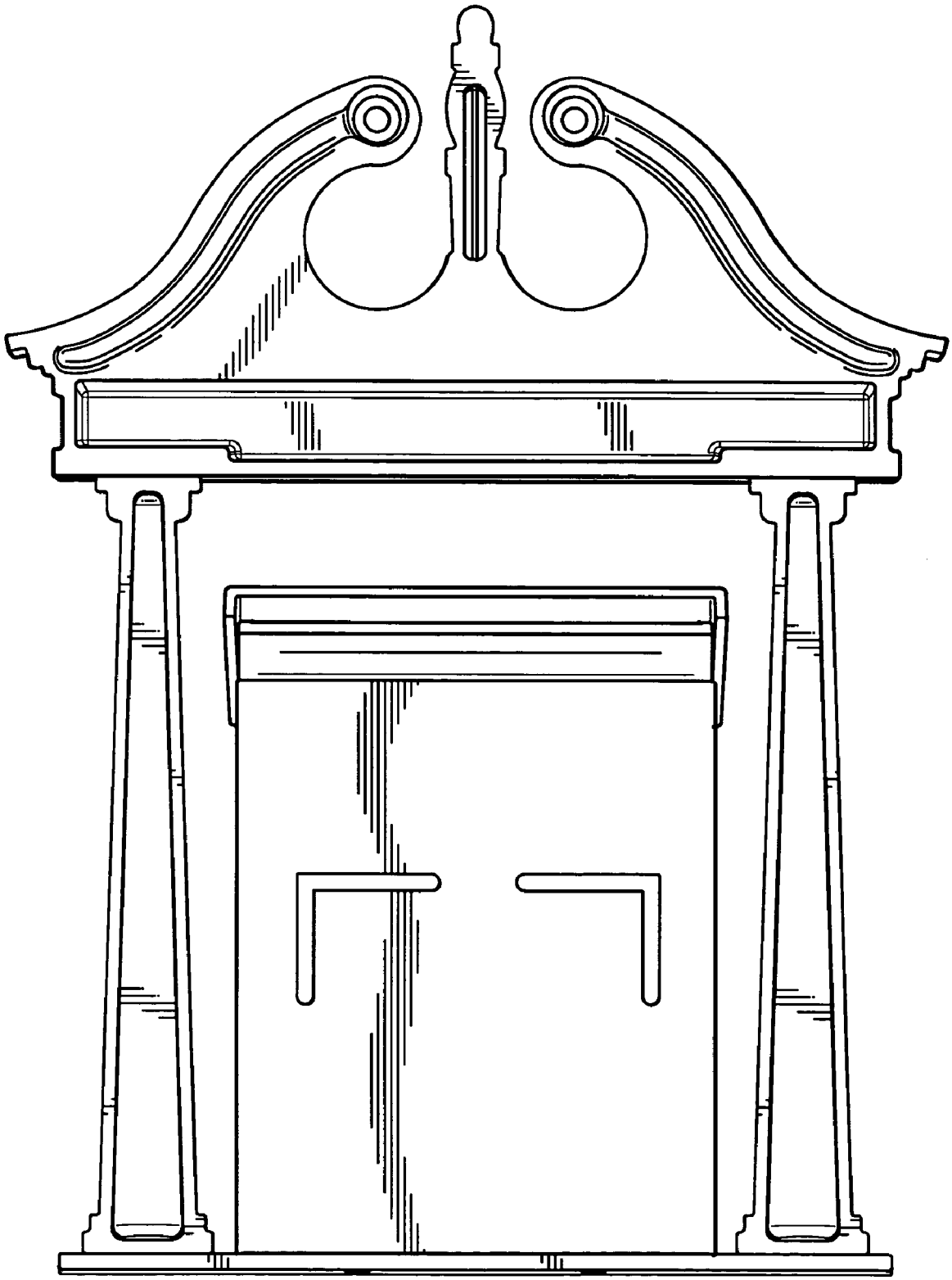
FIG. 7F is back view of the postal receptacle assembly of FIG. 7A.

One representative example embodiment of a postal receptacle component 22 is illustrated in the context of another example postal receptacle assembly in FIG. 4B and FIG. 4F. Features of the postal receptacle component 22 now described can apply for other embodiments of the postal receptacle assembly 20, including postal receptacle assembly 20A, postal receptacle assembly 20B, postal receptacle assembly 20C, and postal receptacle assembly 20D. As shown in FIG. 4B, the postal receptacle component 22 comprises a three dimensional postage receptacle container which defines an essentially hollow internal cavity sized to accept postal items. The postage receptacle container has a backwall 22BW (see FIG. 4F); two vertically extending sidewalls 22LSW and 22RSW; and, a frontwall 22FW. In one embodiment, at least a portion of the front wall of the postage receptacle container is formed by or includes a door 42 which pivots for permitting access to the interior of the postage receptacle container. The door 42 can include a door knob and/or key lock, such as a key lock in a door knob position. The door 42 can also have hinges for pivoting about a vertical axis. As shown, e.g., in FIG. 4F, the postal receptacle component is preferably mounted on the stoop component 24.

The back wall 22BW of the postal receptacle component 22 is essentially flat and flush with rear surfaces of the other assembly components, which are all thus configured for mounting on a vertically oriented member (e.g., surface, post, or wall) of a building. While the postal receptacle assembly 20 can be attached or hung to the vertical member of a building in various ways, in one example implementation attachment of the postal receptacle assembly 20 to the vertical member of the supportive structure or building is achieved mechanically through postal receptacle component 22. In this implementation, the postal receptacle component 22 has means for mounting entire postal receptacle assembly 20 on the vertical member of a building. Such means can take several and diverse forms, such as the inverted L-shaped slits 44 formed on the backwall 22BW. Fasteners (e.g., screws) can be driven through the slits 44 from the inside of the postage receptacle container (with the door 42 opened), with shafts of the fasteners being anchored or engaged in the wall of the supportive building. It will be appreciated further that the slits formed on the backwall 22BW can have other shapes or configurations (e.g., circular slits) or be other types of openings.

A top wall 22TW of the postage receptacle container can take the form of a lid which pivots for permitting access to an interior of the postage receptacle container. Alternatively, the top wall of the postage receptacle container can have a slit or other aperture through which postage items, e.g., letters or postcards, can be inserted.

As one aspect, certain embodiments of the postal receptacle assemblies 20 are configured to emulate visually the appearance of a building or portion of a building, such as a porch. For example, the assembly components 22, 24, 26, and 28 are connected in a manner whereby the postal receptacle assembly simulates a front door and porch of a building. The front wall 22FW of the postal receptacle component 22 simulates the front door of the building, while the remaining components (e.g., stoop component 24, column components 26, and pediment component 28A) simulate the porch.

As a further aspect, in certain embodiments of the postal receptacle assemblies, one or more of the assembly components (known as "stylistic" components) may be formed with (or structurally and/or visually convey) selected architectural features. Preferably the architectural features of the stylistic components are architecturally compatible with the building or structure having the vertical wall, post, or surface upon which the postal receptacle assembly is to be attached or hung. Examples of stylistic components of the postal receptacle assembly include the column components 26 and the pediment component 28.

The column component 26 may express an architectural feature by being one of the following: a column having a shaft with a square cross section; a column having a shaft with a round cross section; and, a column having a shaft with plural discrete shaft sections of differing cross sectional dimensions (e.g., a "Victorian" column). An example of a column having a shaft with a square cross section is column component 26B of postal receptacle assembly 20B shown in FIG. 1B. An example of a column having a shaft with a round cross section is column component 26A of postal receptacle assembly 20A shown in FIG. 1A (as well as column component 26C of postal receptacle assembly 20C shown in FIG. 1C). An example of a column having a shaft with plural discrete shaft sections of differing cross sectional dimensions (e.g., a "Victorian" column) is column component 26D of postal receptacle assembly 20D shown in FIG. 1D, as well as column 26 in FIG. 3 The column 26 in FIG. 3 particularly shows the column shaft has having a first shaft section 80 which essentially uniformly has a first cross-sectional dimension which differs from (is larger than) the essentially uniform cross-sectional dimension of second shaft section 82. A shoulder section 84 of column 26 which is intermediate the first shaft section 82 and the second shaft section 84 has a cross-sectional dimension larger than both the first shaft section 82 and the second shaft section 84.

Other drawings also illustrate the stylistic column components mentioned above. For example, FIG. 5A–FIG. 5F also illustrate a postal receptacle assembly having column components with a square cross section. FIG. 6A–FIG. 6F also illustrate a postal receptacle assembly having column components with a round cross section. FIG. 4A–FIG. 4F illustrate a postal receptacle assembly having Victorian column components.

The pediment component 28 may express an architectural feature by being one of the following: an essentially rectangular ("Greek") pediment; an open-topped pediment (also known as broken-apex pediment); and, an open-bed pediment (also known as broken-bed pediment). An example of a Greek pediment is shown by pediment component 28B in the postal receptacle assembly 20B of FIG. 1B and in the postal receptacle assembly of FIG. 5A–FIG. 5F, wherein the pediment has a generally solid rectangular shape with a crown molding. An example of an open-topped pediment is shown by pediment component 28C in the postal receptacle assembly 20C of FIG. 1C and in the postal receptacle assembly of FIG. 4A–FIG. 4F, in which the pediment has sloping sides which return before reaching the apex, e.g., a "rams head" configuration. An example of an open-bed pediment is shown by pediment component 28A in the postal receptacle assembly 20A of FIG. 1A and in the postal receptacle assembly of FIG. 6A–FIG. 6F, in which the pediment has a generally triangular top surface but has a gap in its base molding.

When two or more of the assembly components are stylistic components, preferably the architectural features of the two or more stylistic components comprise a common architectural style or genre. For example, selection of a Greek pediment component such as pediment component 28B and selection of a column component having a square cross section such as column component 26B results in the postal receptacle assembly 20B of FIG. 1B which has an overall "Greek" architectural style. Alternatively, selection of an open-topped pediment component such as pediment component 28C and selection of a column component having a round cross section such as column component 26C results in the postal receptacle assembly 20C of FIG. 1C which has an overall "classical" or "colonial" architectural style. As another alternative, selection of a triangular/open-bed pediment such as pediment component 28A and selection of a column component having a round cross section such as column component 26A results in the postal receptacle assembly 20A of FIG. 1A which has an overall "arts and crafts" architectural style.

At least one, and preferably all, of the assembly components of a postal receptacle assembly are of a color selected for architectural compatibility with the building or structure to which the postal receptacle assembly is to be mounted.

The present invention also encompasses method for fabricating postal receptacle assemblies (such as those represented by the embodiments discussed above). The method uses the plural assembly components mentioned above, e.g., the postal receptacle component 22, stoop component 24, column components 26, and pediment component 28A. Each of these components is said to be of a differing type, e.g., a stoop component is a differing type of component than a column component; a column component is a differing type of component than a pediment component; and so forth.

The method includes one or more steps of selecting (as a "stylistic" component) at least one of the plural assembly components (e.g., one of the column component and the pediment component) from a collection of assembly components of a same type, differing members of the collection having differing architectural features. Another step of the method involves connecting the plural assembly components (including the stylistic component) whereby the postal receptacle component occupies a space which is at least partially framed by another of the plural assembly components.

Figure 2:
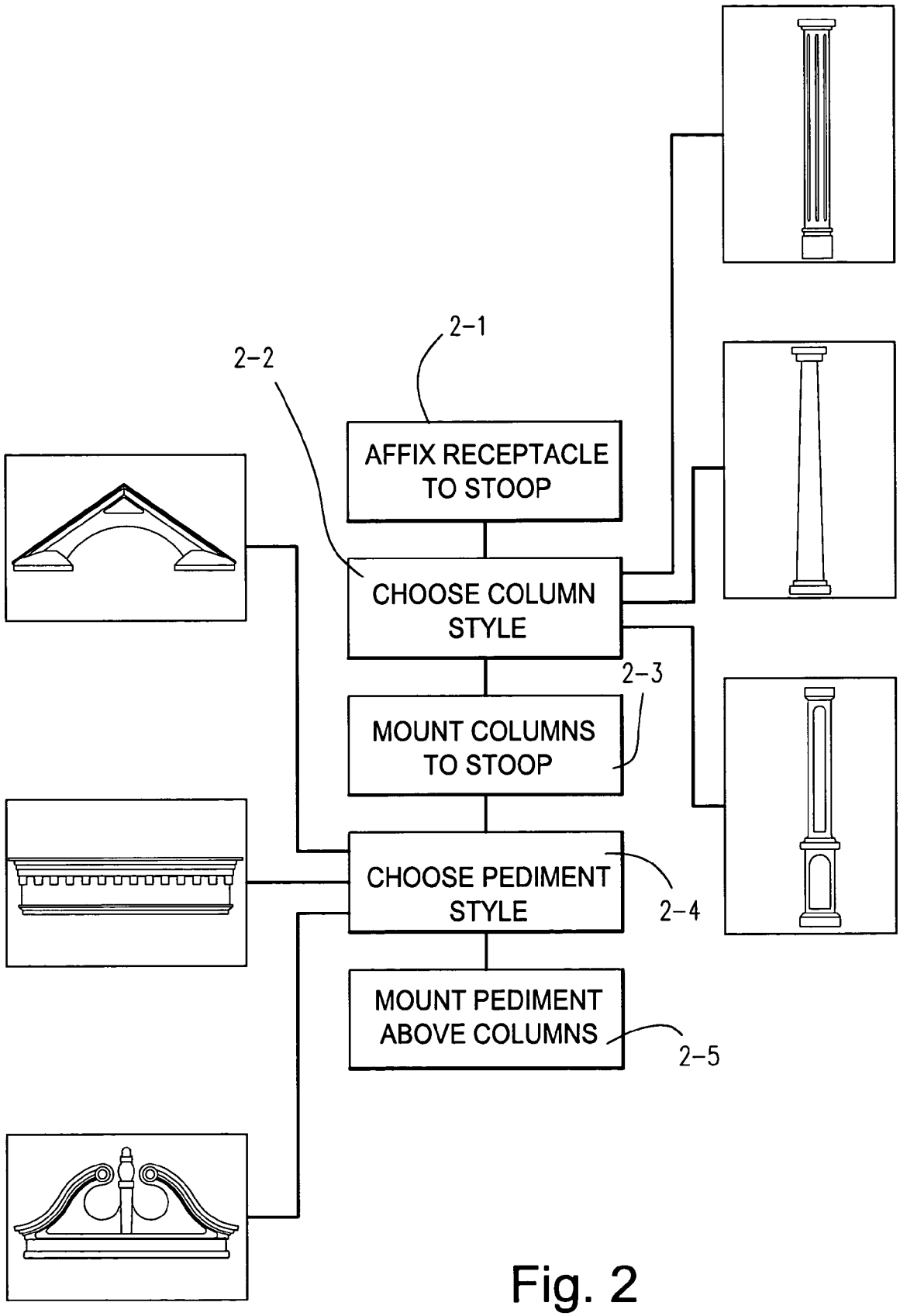
FIG. 2 is a flowchart showing basic, representative steps involved in a method of fabricating a postal receptacle assembly such as the postal receptacle assemblies of FIG. 1A, FIG. 1B, FIG. 1C, and FIG. 1D.
Figure 3:
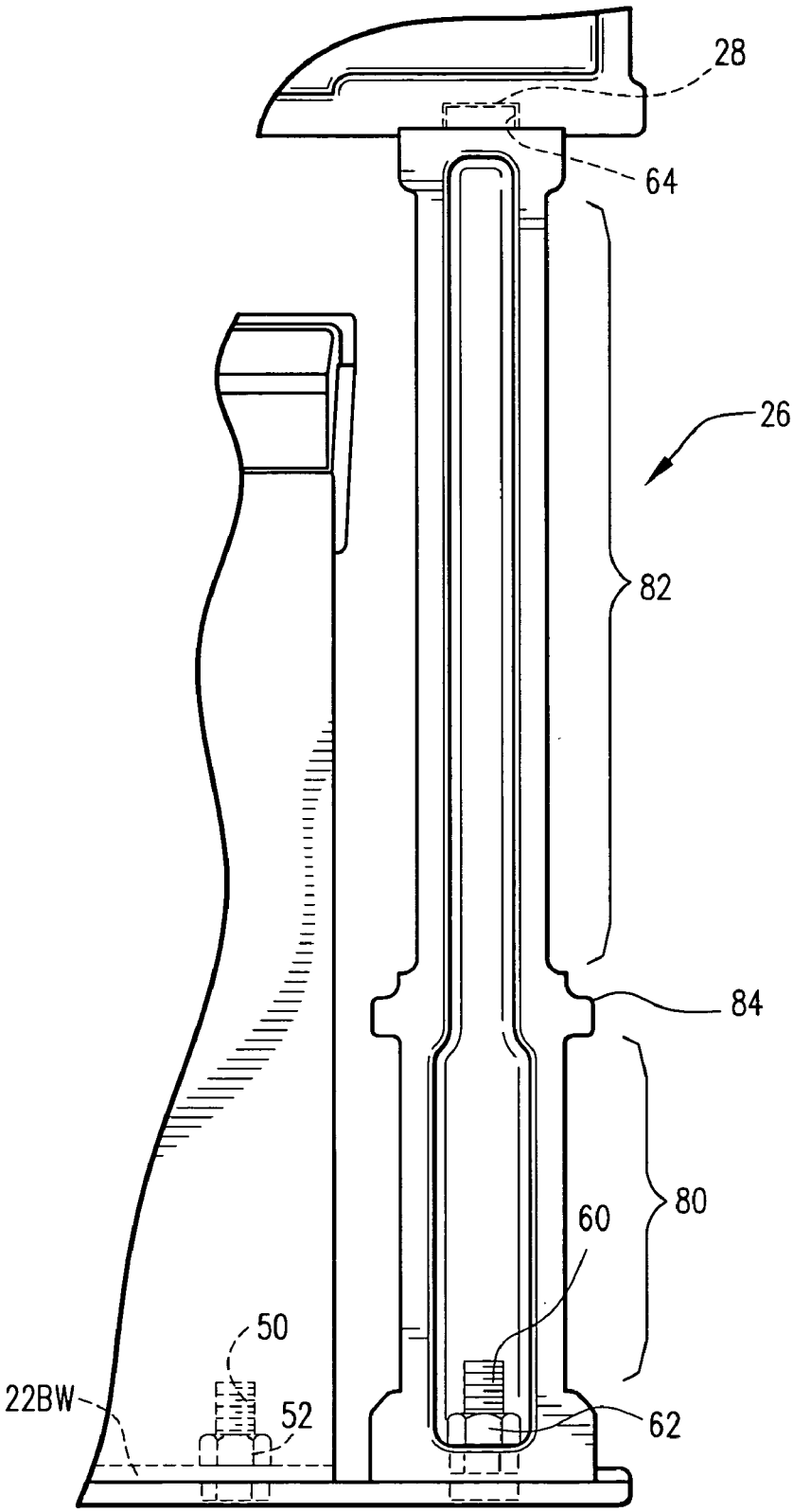
FIG. 3 is a back view of a portion of a postal receptacle assembly, showing an example manner of connecting assembly components.

FIG. 2 shows basic, representative steps involved in a method of fabricating a postal receptacle assembly such as the postal receptacle assemblies of FIG. 1A, FIG. 1B, and FIG. 1C. As step 2-1, the postal receptacle component 22 is affixed to stoop component 24. FIG. 3 illustrates one example way in which step 2-1 may be performed. In particular, FIG. 3 shows that stoop component 24 may be tapped and died from its underside, and an aligned hole drilled in bottom wall 22BW of postal receptacle component 22. An appropriate fastener, such as bolt 50 may be inserted through the recessed hole formed in stoop component 24 and the aligned hole in postal receptacle component 22, and surmounted by nut 52 for the mounting of step 2-1. Several fasteners may be utilized for the mounting of step 2-1, as indicated (for example) by FIG. 4E. Other ways of performing step 2-1 are also possible, e.g., using other types of fasteners, by adhesives, welding, etc.

Step 2-2 is an optional column selection step which is included in a column selection mode of the method. At step 2-2, one or more column components is selected from a collection of column components. The particular collection of column components shown in FIG. 2 has the three members previously discussed: a column having a shaft with a square cross section; a column having a shaft with a round cross section; and, a column having a shaft with plural discrete shaft sections of differing cross sectional dimensions (e.g., a "Victorian" column). The invention is not limited to this particular collection composition, as it should be understood that other column components having other structural and/or architectural features are also envisioned. Further, the number of members of the column component collection is not critical.

As step 2-3, two column components 26 (e.g., the one or more column components 26 selected at step 2-2 when optional step 2-2 is actually performed) are affixed or mounted to the stoop component 24. Mounting of the two column components 26 to stoop component 24 can occur in similar manner to the mounting of the postal receptacle component 22 as previously discussed in conjunction with step 2-1. Therefore, FIG. 3 also illustrates one example way in which step 2-3 may be performed. In particular, FIG. 3 shows that stoop component 24 may be tapped and died from its underside, and an aligned hole drilled in a bottom of each column component 26. An appropriate fastener, such as bolt 60 may be inserted through the recessed hole formed in stoop component 24 and the aligned hole in the column component 26, and surmounted by nut 62 for the mounting of step 2-3. Again it will be appreciated that other ways of performing step 2-3 are also possible, e.g., using other types of fasteners, by adhesives, welding, etc.

Step 2-4 is an optional pediment selection step which is included in a pediment selection mode of the method. At step 2-4, a pediment component is selected from a collection of pediment components. The particular collection of pediment components shown in FIG. 2 has the three members previously discussed: an essentially rectangular ("Greek") pediment; an open-topped or broken-apex pediment; and, an open-bed or broken-bed pediment. The invention is not limited to this particular collection composition, as it should be understood that other pediment components having other structural and/or architectural features are also envisioned. Further, the number of members of the pediment component collection is not critical.

As step 2-5 the pediment component 28 (e.g., the pediment component selected at optional step 2-4 when step 2-4 is actually performed) is mounted on and above the two column components 26 (the two column components 26 having previously been mounted at step 2-3). FIG. 3 further illustrates one example manner in which the pediment component 28 may be mounted to each of the two supporting column components 26. In this example manner, the top of each of the two column components 26 has a male protrusion 64 which is configured and sized to fit in a female receptacle 66 formed in an underside surface of pediment component 28. The fitting of protrusion 64 into receptacle 66 may be accompanied by an adhesive, if desired. Alternatively, the pediment component 28 may be mounted on the two column components 26 by fasteners in similar manner as previously explained with reference to step 2-1 and step 2-3. Yet other mounting techniques are also possible, e.g., using other types of fasteners, by adhesives, welding, etc.

The order of steps of FIG. 2 not particularly significant; it should be understood that various steps can be performed in another order.

In one implementation, the method further comprises performing the selection of step 2-2 and/or the selection of step 2-4, e.g., the step of selecting the stylistic component from the appropriate collection, in accordance with architectural compatibility with or to architecturally complement a building to which the postal receptacle assembly is attached. For example, if the host building is of a Greek architectural style or at least has some features of a Greek architectural style, step 2-2 and step 2-2 can be performed so that the two column components selected are the column components 26B of FIG. 1B and the pediment selected at step 2-4 is the pediment component 28B of FIG. 1B. With such judicious matching selection, the architectural style of the postal receptacle assembly is rendered architectural compatible with the host building.

In the example implementations herein discussed and illustrated, the method involves connecting the plural assembly components whereby the connected components visually emulate an appearance of a building or portion of a building, such as a porch (for example), and quite possibly a porch of the host building.

The assembly components can be fabricated from any desired material such as (for example), metal, plastics, or wood. The method optionally includes a further step of selecting a color for each of the assembly components. Preferably the color is compatible with, complements, or accents a coloring of the host building.

Advantageously the postal receptacle assembly method described herein facilitates customization of fabrication of a postal receptacle assembly to achieve a desired architectural visual effect. The postal receptacle assembly may have architectural compatibility with the host building. Such compatibility may be achieved by using customized column components and/or a customized pediment component to match the architectural features of the host building. The postal receptacle component 22 is thus framed by components having architectural style, e.g., an architectural style compatible with the host building. Moreover, a portion of the host building can be viewed through space 30 which is defined and bordered by the stoop component 24, the two column components 26, and the pediment component 28.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A postal receptacle assembly comprising:
- a horizontally-oriented stoop;
- two columns mounted on the stoop and extending essentially vertically in spaced apart relationship;
- a pediment supported by the two columns;
- a postal receptacle situated in a space framed by the stoop, the pediment, and the two columns, the postal receptacle having a backwall which is essentially flush with rear surfaces of the stoop, the two columns, and the pediment, whereby the postal receptacle backwall and the rear surfaces of the stoop, the two columns, and the pediment are configured for mounting on a vertical member of a host building; the postal receptacle comprising an essentially hollow container, the container comprising the postal receptacle back wall, two vertically extending sidewalls, and a front wall wherein in at least a portion of the front wall is formed by a front door which pivots for permitting access to the interior of the hollow container; and wherein the postal receptacle further comprises a lid which pivots for permitting access to the interior of the hollow container.

2. The apparatus of claim 1, wherein the postal receptacle is mounted on the stoop, the stoop being below the postal receptacle in a vertical direction.

3. The apparatus of claim 1, wherein the postal receptacle further comprises means for mounting of the postal receptacle assembly on the vertical member of the host building.

4. The apparatus of claim 1, wherein the postal receptacle assembly is configured to emulate the appearance of a porch.

5. The apparatus of claim 1, wherein both columns are one of the following:
- a column having a shaft with a square cross section;
- a column having a shaft with a round cross section;
- a column having a shaft with plural discrete shaft sections of differing cross sectional dimensions.

6. The apparatus of claim 1, wherein the pediment is one of the following:
- an essentially rectangular pediment;
- an open-topped or broken-apex pediment;
- an open-bed or broken-bed pediment.

7. The apparatus of claim 1, wherein a through space is defined by the stoop, the two columns, and the pediment for permitting viewing of a portion of the host building through the through space.

8. The apparatus of claim 1, wherein the two columns and the pediment have architectural features which are chosen to be of a same architectural genre and compatible with the host building.

9. The apparatus of claim 1, wherein the postal receptacle front wall extends in two dimensions to simulate the front door and wherein the two columns are situated in spaced-apart relationship, and wherein the postal receptacle is intermediate the two columns in one of the dimensions.

10. A postal receptacle assembly for mounting on a vertical member of a host building, the postal receptacle assembly comprising:
- a horizontally-oriented stoop;
- two columns mounted on the stoop and extending essentially vertically in spaced apart relationship;
- a pediment supported by the two columns;
- a postal receptacle situated in a space framed by the stoop, the pediment, and the two columns; and
- wherein a through space is defined by the stoop, the two columns, and the pediment for permitting viewing of a portion of the host building through the through space; the postal receptacle comprises an essentially hollow container, the container comprising a back wall, two vertically extending sidewalls, and a front wall wherein at least a portion of the front wall is formed by a front door which pivots for permitting access to the interior of the hollow container; and wherein the postal receptacle further comprises a lid which pivots for permitting access to the interior of the hollow container.

11. The apparatus of claim 10, wherein the two columns and the pediment have architectural features which are chosen to be of a same architectural genre and compatible with the host building.

12. The apparatus of claim 10, wherein the postal receptacle front wall extends in two dimensions to simulate the front door and wherein the two columns are situated in spaced-apart relationship, and wherein the postal receptacle is intermediate the two columns in one of the dimensions.

13. The apparatus of claim 10, wherein the postal receptacle assembly is configured to emulate the appearance of a porch.

14. A postal receptacle assembly for mounting on a vertical member of a host building, the postal receptacle assembly comprising:

a horizontally-oriented stoop;

two columns mounted on the stoop and extending essentially vertically in spaced apart relationship;

a pediment supported by the two columns;

a postal receptacle situated in a space framed by the stoop, the pediment, and the two columns; and wherein the two columns and the pediment have architectural features which are chosen to be of a same architectural genre and compatible with the host building; the postal receptacle comprises an essentially hollow container, the container comprising a back wall, two vertically extending sidewalls, and a front wall wherein at least a portion of the front wall is formed by a front door which pivots for permitting access to the interior of the hollow container; and wherein the postal receptacle further comprises a lid which pivots for permitting access to the interior of the hollow container.

15. The apparatus of claim 14, wherein the postal receptacle front wall extends in two dimensions to simulate the front door and wherein the two columns are situated in spaced-apart relationship, and wherein the postal receptacle is intermediate the two columns in one of the dimensions.

16. The apparatus of claim 14, wherein the postal receptacle assembly is configured to emulate the appearance of a porch.

17. The apparatus of claim 14, wherein both columns are one of the following:

a column having a shaft with a square cross section;

a column having a shaft with a round cross section;

a column having a shaft with plural discrete shaft sections of differing cross sectional dimensions.

18. The apparatus of claim 14, wherein the pediment is one of the following:

an essentially rectangular pediment;

an open-topped or broken-apex pediment;

an open-bed or broken-bed pediment.

19. A postal receptacle assembly comprising:

a horizontally-oriented stoop;

two columns mounted on the stoop and extending essentially vertically in spaced apart relationship;

a pediment supported by the two columns;

a postal receptacle situated in a space framed by the stoop, the pediment, and the two columns; and wherein the postal receptacle has a front wall which extends in two dimensions to simulate a front door and wherein the two columns are situated in spaced-apart relationship, and wherein the postal receptacle is intermediate the two columns in one of the dimensions; the postal receptacle comprises an essentially hollow container, the container comprising a back wall, two vertically extending sidewalls, and the front wall wherein at least a portion of the front wall is formed by the front door which pivots for permitting access to the interior of the hollow container; and wherein the postal receptacle further comprises a lid which pivots for permitting access to the interior of the hollow container.

20. The apparatus of claim 19, wherein the postal receptacle assembly is configured to emulate the appearance of a porch.

* * * * *